US009469516B2

(12) United States Patent
Jussila

(10) Patent No.: US 9,469,516 B2
(45) Date of Patent: Oct. 18, 2016

(54) TELESCOPICALLY LENGHTENING/SHORTENING POWER UNIT

(75) Inventor: Veli-Matti Ilari Jussila, Lempäälä (FI)

(73) Assignee: Velvision Oy, Tampere (FI)

( * ) Notice: Subject to any disclaimer, the term of this patent is extended or adjusted under 35 U.S.C. 154(b) by 296 days.

(21) Appl. No.: 13/577,062

(22) PCT Filed: Feb. 4, 2011

(86) PCT No.: PCT/FI2011/000007

§ 371 (c)(1),
(2), (4) Date: Oct. 1, 2012

(87) PCT Pub. No.: WO2011/095673

PCT Pub. Date: Aug. 11, 2011

(65) Prior Publication Data

US 2013/0043445 A1 Feb. 21, 2013

(30) Foreign Application Priority Data

Feb. 5, 2010 (FI) ..... 20100042

(51) Int. Cl.
*B66F 3/10* (2006.01)
*B66F 11/04* (2006.01)

(52) U.S. Cl.
CPC . *B66F 11/04* (2013.01); *B66F 3/10* (2013.01)

(58) Field of Classification Search
USPC ..... 254/11–14, 41, 229, 232–240, 84, 85, 254/424–425, 92, 98–103, 134; 269/61
See application file for complete search history.

(56) References Cited

U.S. PATENT DOCUMENTS

| | | | | | |
|---|---|---|---|---|---|
| 2,069,012 | A | * | 1/1937 | Lynes | 254/102 |
| 2,091,858 | A | * | 8/1937 | Johnson | 254/102 |
| 2,739,788 | A | * | 3/1956 | Weaver | 254/102 |
| 3,851,854 | A | | 12/1974 | Roybal | |
| 4,831,291 | A | * | 5/1989 | Ames | 310/13 |

(Continued)

FOREIGN PATENT DOCUMENTS

| | | | | |
|---|---|---|---|---|
| CN | 2809309 | | 8/2006 | |
| CN | 201187564 | * | 1/2009 | F16H 25/20 |

(Continued)

OTHER PUBLICATIONS http://stelray.com/density_val.htm, Density Values—Selected Resins, Nov. 20, 2008, note: nylon densities.*

*Primary Examiner* — Joseph J Hail
*Assistant Examiner* — Jon Taylor
(74) *Attorney, Agent, or Firm* — Ware, Fressola, Maguire & Barber LLP

(57) ABSTRACT

Power unit that can be telescopically lengthened or shortened and performs linear movement, and includes cylindrical parts moving telescopically within each other. The cylindrical parts are equipped with at least external or internal threads to form a power unit that can be lengthened or shortened when the parts are being rotated in relation to each other. At least one cylindrical part is locked to be non-rotating or locked to rotate differently than a last cylindrical part to which a rotating producing movement to the power unit is arranged. The cylindrical parts are made of plastic and the inner diameter of the part having the smallest diameter is over 25% of the useful height produced by the smallest cylindrical part.

14 Claims, 3 Drawing Sheets

(56) References Cited

U.S. PATENT DOCUMENTS

| | | | | |
|---|---|---|---|---|
| 5,588,264 | A * | 12/1996 | Buzon | 52/126.6 |
| 5,953,802 | A * | 9/1999 | Radzio | 29/239 |
| 6,247,718 | B1 * | 6/2001 | Gobbers et al. | 280/304.1 |
| 6,502,667 | B1 | 1/2003 | Mead et al. | |
| 2005/0161649 | A1 * | 7/2005 | Kawasaki et al. | 254/102 |
| 2007/0294828 | A1 | 12/2007 | Hornbach et al. | |

FOREIGN PATENT DOCUMENTS

| | | | | |
|---|---|---|---|---|
| CN | 201187564 | Y * | 1/2009 | F16H 25/20 |
| DE | 2527544 | | 1/1976 | |
| DE | 3305074 | | 8/1984 | |
| DE | 19818821 | | 11/1999 | |
| DE | 19910545 | | 7/2000 | |
| GB | 970879 | | 9/1964 | |
| JP | 9-202594 | | 8/1997 | |
| JP | 10-220548 | | 8/1998 | |
| JP | 2002-327824 | | 11/2002 | |
| JP | U3122036 | | 5/2006 | |
| JP | 2007-39220 | | 2/2007 | |
| WO | WO 9533674 | | 12/1995 | |

* cited by examiner

TELESCOPICALLY LENGHTENING/SHORTENING POWER UNIT

CROSS REFERENCE TO RELATED APPLICATIONS

This application is the U.S. National Stage of International Application Number PCT/FI2011/000007 filed on Feb. 4, 2011 which was published in English on Aug. 11, 2011 under International Publication Number WO 2011/095673 and which claims priority to Finnish patent application 20100042 filed on Feb. 5, 2010, which application is hereby incorporated by reference.

TECHNICAL FIELD

The present invention relates to a power unit performing linear movement and that can be telescopically lengthened or shortened. The power unit comprises cylindrical parts that move telescopically within each other, and are equipped at least with external or internal threads. This forms a power unit that can be lengthened or shortened by rotating the cylindrical parts in relation to each other. At least one of the cylindrical parts is locked to be non-rotating or is locked to rotate in a different direction or at a different speed than the part of the mentioned parts to which part rotating causing movement for the power unit is arranged.

BACKGROUND OF THE INVENTION

Previously, cylinders that can be extended with hydraulic pressure or compressed air are known as power units that can be telescopically extended. The purpose of use of these units is mostly lifting, in which case the recovery of the cylinder to be short occurs with the help of gravitational force by letting the pressure out of the cylinders. If gravitational force and removal of the pressure cannot be used to pull this kind of cylinder back to be short, mechanical pulling devices, such as withdraws occurring with a wire draw are known.

From a Chinese publication CN 2809309Y telescopic parts equipped with threads that are needed for uplifting of a lifting platform construction are known, in which telescopic parts can be extended and shortened in relation to each other by rotating. In this construction the telescopic parts are made of metal and they are considerably heavy. In order to avoid excessive increase of the weight, the telescopic parts have as small a diameter as possible. In order to function, one such power unit requires yet the fact that at least one telescopic part be locked to be non-rotating. A construction with a size of a power unit will thus increase the weight of the construction. When the telescopic parts are made to have small diameters in order to save weight, the construction will buckle easily if one tries to achieve great endurance of the load and lifting height or great elongation with it.

SUMMARY OF THE INVENTION

With the power unit equipped with telescopic parts according to the invention unexpected improvements can be achieved over the existing prior art. It is characteristic of the invention that in order to reduce the construction weight of the power unit, the telescopic parts are made of plastic and the inner diameter of the telescopic part having the smallest diameter is over 25% of the useful height produced by the smallest telescopic part.

The advantage of the power unit according to the invention is its lightness, weather resistance and a great buckling resistance. Further, the power unit is not position sensitive but functions in all positions in a controlled way by lengthening and shortening. Therefore, it is suitable for a vertical and horizontal installation and also is suitable for any installation direction. One end of the power unit is locked to be non-rotating while the other end is being rotated. This occurs with the help of a profile bar directed inside the power unit, and also with the help of an external construction of the power unit if the above mentioned locking is necessary.

The rotating equipment of the rotatable telescopic part and the gearing belonging to it, such as a planetary gear, can be adjusted even inside the part itself in which case the construction length of the power unit does not become longer. When the telescopic parts are plastic cylinders with relatively thick walls, their threads are easy to manufacture, a lot of bearing area can be gained to the threads, the threads do not become damaged easily and they do not cause significant friction.

BRIEF DESCRIPTION OF THE DRAWINGS

In the following the invention is described more detailed by referring to the accompanying drawings in which.

DETAILED DESCRIPTION

Figure 1:
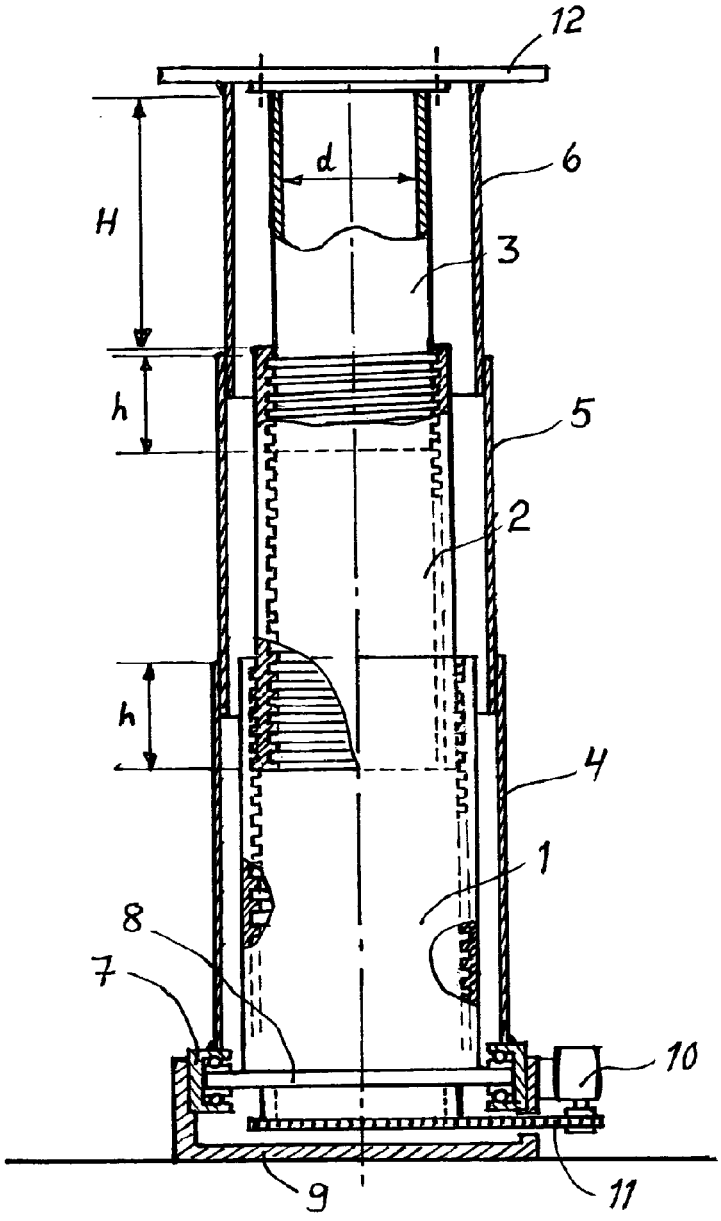
FIG. 1 shows a power unit as a side view partly sectioned.

In FIG. 1 a power unit is shown formed with telescopic parts 1-3 made of plastic material. The telescopic parts 1-3 are attached to each other by threading, and one implementation form is such that the inner part of each of telescopic parts 1 and 2 is threaded and the outer surface of each of telescopic parts 2 and 3 is threaded at their respective bottom sections, covering the distance h. When the lowest telescopic part 1 is being rotated with the help of a motor 10 and chain gear 11, and the uppermost telescopic part 3 is being kept as non-rotating. In one embodiment, the base 12 is affixed to the uppermost telescopic part 3, such that the power unit lengthens and shortens depending on the direction of rotation of the motor. Only the parts 1 and 2 rotate. Preferably, each threaded part has the same pitch per cycle.

The lowest, rotating cylindrical part 1 of the power unit is bearing-mounted to a base 9 from its flange 8 with the help of a bearing 7. The bearing 7 receives vertical forces directed both downwards and upwards. Thus, with the power unit the base 12 can be pushed when the power unit 12 is lengthening and pulled when the power unit is shortening.

In FIG. 1, a solution to keep the base 12 and the uppermost part 3 as non-rotating with the help of an external, telescopic profile construction 4-6 is shown. The profile construction 4-6 is, for example, multiple quadrangular pipes attached telescopically within each other to each other. These pipes convey from the non-rotating frame of the bearing 7 force that keeps the base 12 as non-rotating. The profile construction functions in use also as a casing so that the threads of the parts 1-3 stay clean.

Figure 2:
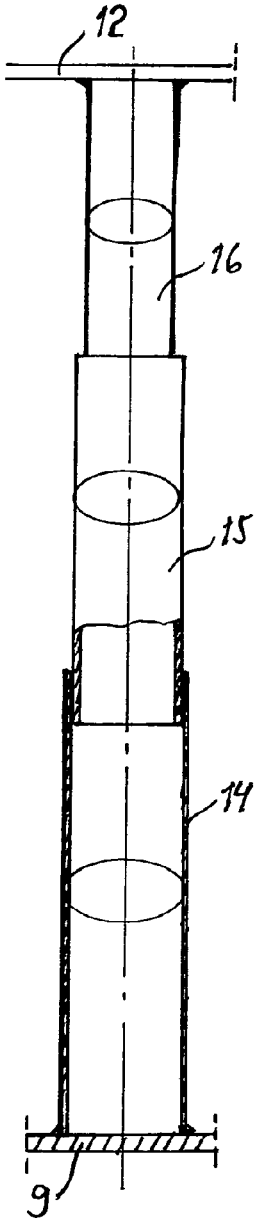
FIG. 2 shows a telescopic profile bar.
Figure 4:
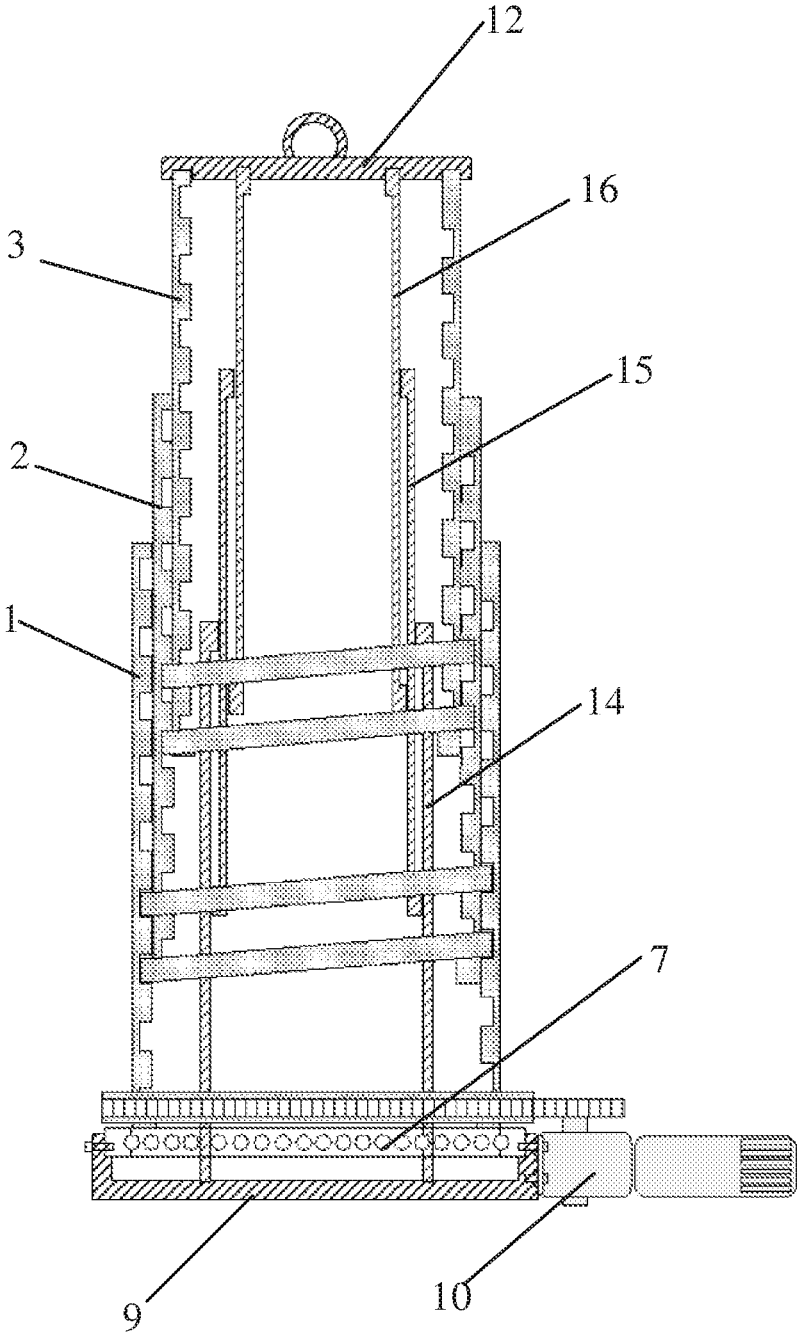
FIG. 4 shows cross-sectional view of a power unit comprising a telescopic profile bar.

In FIGS. 2 and 4, a corresponding hollow profile bar 14-16 is shown that can be adjusted inside the power unit. The profile bar 14-16 is attached to the base 9 from its lower end and to the base 12 from its upper end. The profile bar has an elliptical cross section. This prevents rotation of the uppermost telescopic part 3.

The uppermost telescopic part 3 can be locked to be non-rotating, but this feature is not essential to the functioning of the power unit. The uppermost telescopic part 3 can rotate in a different direction than the rotated lowest telescopic part 1 or with a different speed than the rotated lowest telescopic part 1.

The telescopic parts 1-3 are plastic cylinders, the wall thickness of which is approximately 30 mm. Trapeze threads of sufficient size can easily be worked at the inner surface of the cylinders, from which, bearing area can be gained. For the telescopic part 3 having the smallest diameter, a certain diameter size is chosen according to the maximum load of the power unit in which case the parts stay at the longest exit position and stay fully loaded without buckling.

The inner diameter d of each telescopic part 1-3 being made of plastic raw material is advantageously over 25% of the useful height H, which is the height of the portion of the telescopic part that extends from the adjacent telescopic part.

The lightness of the power unit can be achieved with the help of plastic materials, such as polyamides used as base material of the telescopic parts 1-3. The density of this material is preferably 1.4 kg/dm$^3$ or less. The telescopic parts 1 and 2 have threads covering the whole inner surface. The telescopic part 3 has threads only at the outer surface at its lower part covering the height h. Similarly the telescopic part 2 has threads at the outer surface covering only the height h. The rotating of the telescopic parts 2 and 3 out of the adjacent telescopic part is prevented, for example, by the end of the inner thread part before the edge banding. The rotating of the telescopic part 1 can also rotate the telescopic part 2 until the rotation of telescopic part 2 occurs or telescopic part 1 rotates its whole movement distance and then it begins to rotate the telescopic part 2. The number of the telescopic parts 1-3 in the power unit is not limited to three, but in alternative embodiments according to the invention, there can be more than three telescopic parts.

The plastic material of the telescopic parts 1-3 is most advantageously polyamide and specially most advantageously is a so called self-lubricating, slippery plastic material or is mixed with some known mineral fillers or formed to be a composite construction in order to improve the material properties, such as in order to reinforce the material, to reduce the friction in the threads or improve the weather resistance. Further, the plastic material of the parts can be reinforced with known fibre reinforcements, the outer casing of the parts can be reinforced with fibres or with a reinforcement net. Also, the surfaces of the threads can be treated or coated in order to reduce friction.

The stress of the threads of the power unit can be lightened during the extension movement of the power unit. For example, compressed air can be directed into the power unit, in which case the compressed air extends the length of the power unit.

Figure 3:
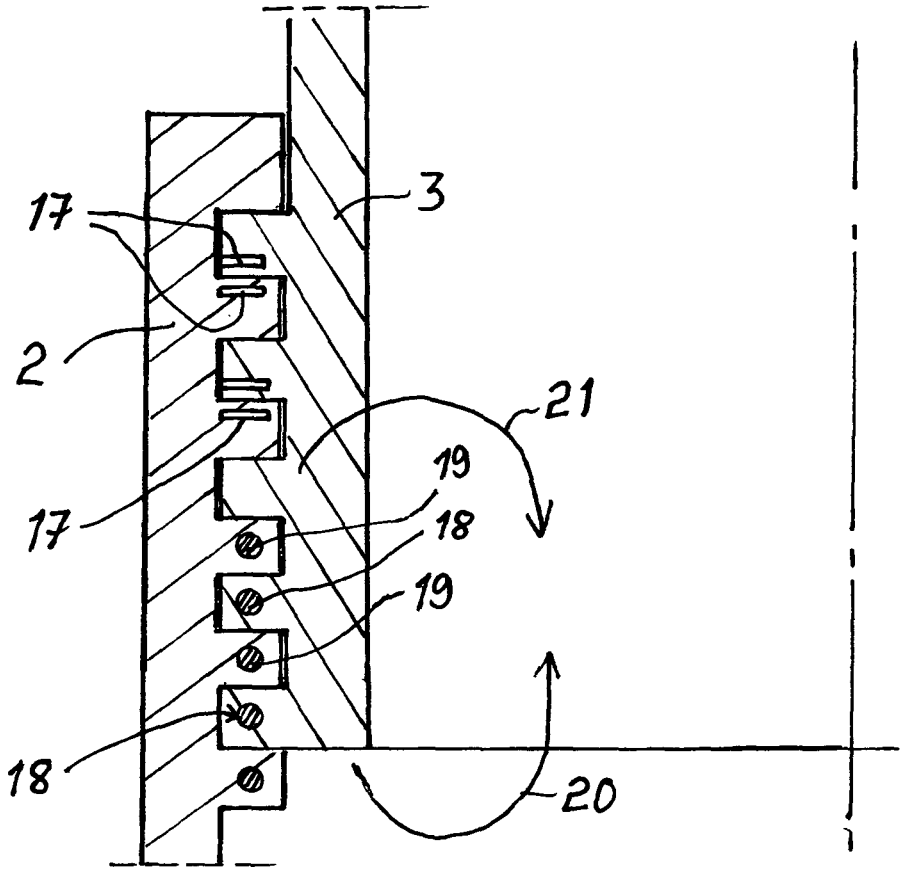
FIG. 3 shows magnetic devices installed to the threads.

In FIG. 3 a solution is shown in order to reduce the friction stress of the threads. For example, banded permanent magnets 17 are located to the threads of the telescopic parts 2 and 3 in such a way that the magnets 17 of the adjacent threads repel each other so that the magnet of the thread of the lower part 2 repels the magnet of the thread of the upper telescopic part 3 and thus aims to support the thread of the upper telescopic part 3.

As an alternative, coils 18 located in threads to one telescopic part 3 and coils 19 in the another telescopic part 2 are shown in FIG. 3. By leading DC current of opposite sign to the coils 18 and 19 in such a way that magnetic fields 20 and 21 repel each other, support effect to the telescopic part 3 can also be achieved through the threads.

The invention claimed is:

1. A power unit that can be telescopically lengthened or shortened and performs linear movement, comprising:

a plurality of cylindrical parts each comprising external or internal threads so that the plurality of cylindrical parts are configured to move telescopically within each other when the plurality of cylindrical parts are being rotated in relation to each other, wherein at least a first cylindrical part of the plurality of cylindrical parts is locked to be non-rotating, wherein the plurality of cylindrical parts are made of plastic, wherein an inner diameter of the first cylindrical part has the smallest diameter of the plurality of cylindrical parts and the inner diameter of said first cylindrical part is over 25% of a maximum useful height part of the first cylindrical part, and, wherein the power unit further comprises:

a telescopic bar inside the plurality of cylindrical parts having a profile that deviates from a round form, and wherein the telescopic bar keeps the first cylindrical part non-rotational.

2. The power unit according to claim 1, wherein the telescopic bar has an elliptical cross section.

3. The power unit according to the claim 1, characterized in that the first cylindrical part is attached to a base in a non-rotating way.

4. The power unit according to the claim 1, further comprising:

a rotating motor attached to and configured to rotate the last cylindrical part.

5. The power unit according to the claim 1, wherein the power unit is a lifting and lowering power unit or a pushing and pulling power unit functioning in any direction.

6. The power unit according to the claim 1, characterized in that the threads of each of the plurality of cylindrical parts are equipped with a pitch of equal size per a cycle.

7. The power unit according to the claim 1, characterized in that the threads of each of the plurality of cylindrical parts have a profile equal to trapeze threads.

8. The power unit according to the claim 1, characterized in that each of the plurality of cylindrical parts are made of polyamide plastic or are made of mixed/reinforced polyamide plastic.

9. The power unit according to the claim 1, characterized in that the density of the material forming each of the plurality of cylindrical parts is under 1.4 kg/dm$^3$.

10. The power unit according to the claim 1, characterized in that each of the plurality of cylindrical parts comprises outer casings reinforced with fibre or net reinforcements.

11. The power unit according to the claim 1, characterized in that in order to reduce the friction between the threads of the plurality of cylindrical parts, magnetic devices are between each of the plurality of cylindrical parts to provide a support effect affecting the threads and reducing surface pressure on the threads.

12. The power unit according to claim 1, wherein stress of the threads is reduced during extension movement of the power unit by directing compressed air inside the power unit.

13. The power unit according to claim 1, wherein the useful height of the first cylindrical part is not threaded.

14. The power unit according to claim 1, wherein each cylindrical part of the plurality of cylindrical parts, except the last cylindrical part, has a maximum useful height, wherein a diameter of each cylindrical part having a maximum useful height is over 25% of the maximum useful height of the respective cylindrical part.

* * * * *